US006205764B1

(12) United States Patent
Hermann et al.

(10) Patent No.: US 6,205,764 B1
(45) Date of Patent: Mar. 27, 2001

(54) METHOD FOR THE ACTIVE DAMPING OF COMBUSTION OSCILLATION AND COMBUSTION APPARATUS

(76) Inventors: Jakob Hermann, Am Mülberg 2, D-82282 Oberweikertshofen; Carl-Christian Hantschk, Bromberger Strasse 43, D-81929 München; Peter Zangl, Destouchesstrasse 71, D-80796 München; Dieter Vortmeyer, Wilhelm-Duell-Strasse 5, D-80683 München; Armin Orthmann, Rotwandstrasse 12, D-85609 Aschheim, all of (DE)

( * ) Notice: Subject to any disclaimer, the term of this patent is extended or adjusted under 35 U.S.C. 154(b) by 0 days.

(21) Appl. No.: 09/369,720

(22) Filed: Aug. 6, 1999

Related U.S. Application Data

(63) Continuation of application No. PCT/DE98/00211, filed on Jan. 23, 1998.

(30) Foreign Application Priority Data

Feb. 6, 1997 (DE) ..... 197 04 540

(51) Int. Cl.[7] ..... F02C 7/00
(52) U.S. Cl. ..... 60/39.06; 60/725; 431/114
(58) Field of Search ..... 60/39.06, 39.182, 60/725; 431/114

(56) References Cited

U.S. PATENT DOCUMENTS

| | | | | |
|---|---|---|---|---|
| 4,406,117 | | 9/1983 | Rowen et al. . | |
| 5,303,542 | | 4/1994 | Hoffa . | |
| 5,361,710 | | 11/1994 | Gutmark et al. . | |
| 5,544,478 | * | 8/1996 | Shu et al. | 60/725 |
| 5,575,144 | * | 11/1996 | Brough | 60/725 |
| 5,809,769 | * | 9/1998 | Richards et al. | 60/725 |

OTHER PUBLICATIONS

International Publication No. WO 93/10401 (Schetter), dated May 27, 1993.

"Active damping of self–excited combustion chamber vibrations (AIC) in pressure atomizer burners by means of modulation of the fluidic fuel supply", (Hermann et al.), VDI Reports, No. 10909, 1993, pp. 615–623.

* cited by examiner

*Primary Examiner*—Louis J. Casaregola
(74) *Attorney, Agent, or Firm*—Herbert L. Lerner; Laurence A. Greenberg; Werner H. Stemer

(57) ABSTRACT

A method for the active damping of combustion oscillation in a combustion chamber uses at least two actuating members. Control of the actuating members necessitates measurement of the combustion oscillation at fewer points than there are actuating members. That is achieved, in particular, by utilizing the symmetry of natural acoustic oscillation in the combustion chamber. A combustion apparatus is also provided.

5 Claims, 1 Drawing Sheet

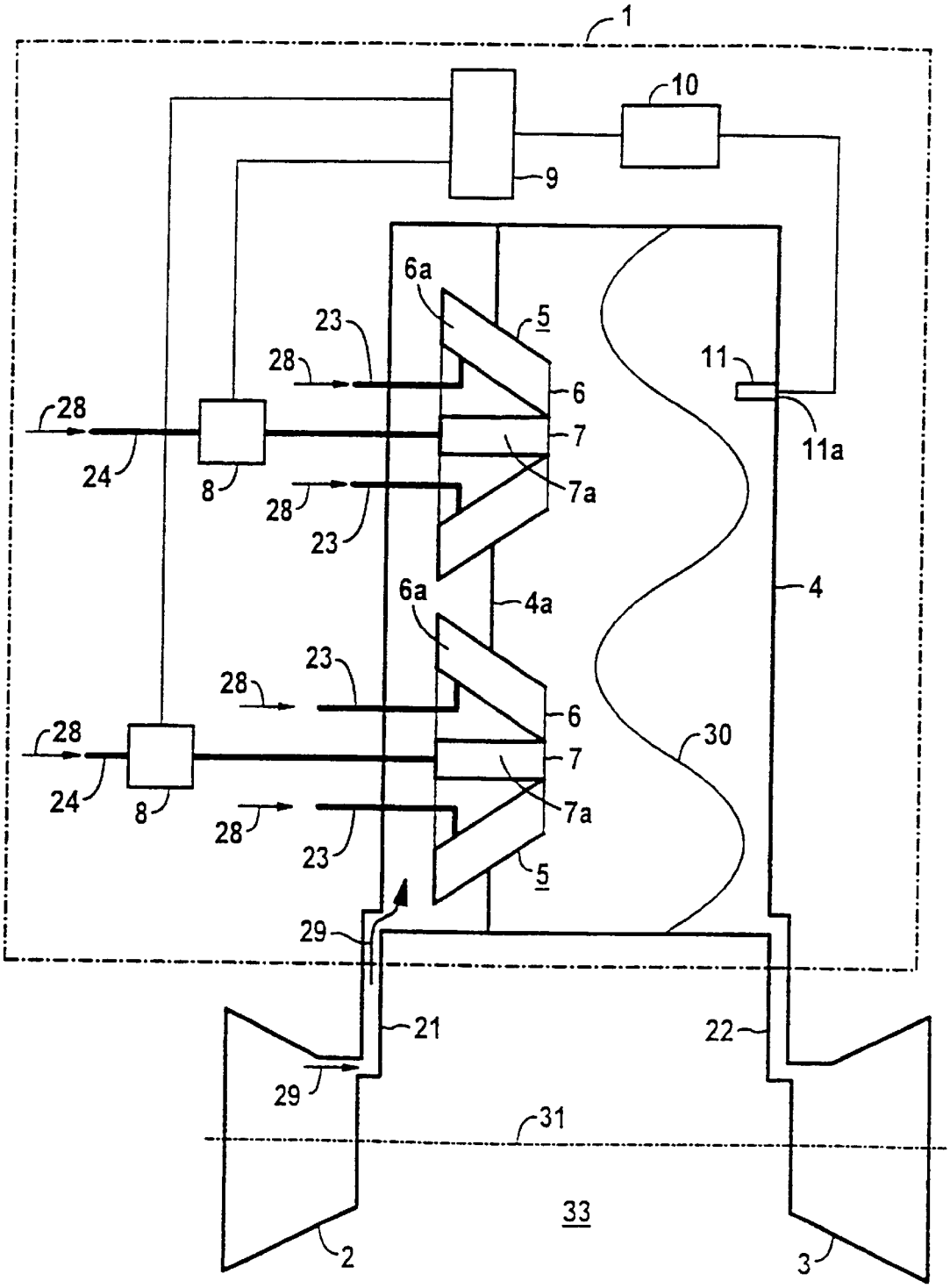
1
10
9
6a
5
23
28
11
6
28
7
11a
24
8
7a
28
23
6a
4a
4
23
28
6
28
7
30
24
8
7a
28
23
5
29
21
22
29
31
33
2
3

METHOD FOR THE ACTIVE DAMPING OF COMBUSTION OSCILLATION AND COMBUSTION APPARATUS

CROSS-REFERENCE TO RELATED APPLICATION

This application is a continuation of copending International Application No. PCT/DE98/00211, filed Jan. 23, 1998, which designated the United States.

BACKGROUND OF THE INVENTION

Field of the Invention

The invention relates to a method for the active damping of combustion oscillation in a combustion chamber and to a corresponding combustion apparatus.

An article entitled "Aktive Dampfung selbsterregter Brennkammerschwingungen (AIC) bei Druckzerst äuberbrennern durch Modulation der flüssigen Brennstoffzufuhr" [Active Damping of Self-Excited Combustion-Chamber Oscillations (AIC) in Pressure Atomizer Burners by Modulating the Liquid Fuel Supply] by J. Herrmann, D. Vortmeyer and S. Gleiβ, in VDI Reports No. 1090, 1993, describes how combustion oscillation occurs in a combustion chamber and how it can be actively damped. During combustion, in a combustion chamber, for example of a turbine, self-excited combustion oscillation may occur, which is also referred to as combustion instability. Such combustion oscillation arises as a result of interaction between a fluctuating release of power during combustion and acoustics of the combustion chamber. Combustion oscillation is often accompanied by high noise emission and mechanical load on the combustion chamber, which may lead to structural parts being destroyed. Active damping of combustion oscillation is achieved by modulation through the use of an actuating member (piezoelectric actuator). The actuating member modulates a fuel quantity which is supplied to a burner. A microphone records the acoustic oscillations in the combustion chamber. A regulating signal for regulating the modulation of the fuel quantity being supplied is derived from a microphone signal in such a way that the modulation of the fuel quantity being supplied takes place anti-cyclically to the combustion oscillation.

International Publication No. WO93/10401 has disclosed a burner configuration with two burners in a common combustion chamber. Each of the burners can be supplied with fuel through a fuel line. An acoustically acting element is coupled to a fuel line. It is preferably a passive element, in the form of a Helmholtz resonator, for example, which modifies the acoustic properties of the fuel line, i.e. which acoustically detunes the fuel line. In another configuration, the acoustically acting element is a loudspeaker which acts on fuel flowing through the fuel line. According to the single embodiment disclosed, the loudspeaker is driven through the use of a microphone disposed outside the combustion chamber.

SUMMARY OF THE INVENTION

It is accordingly an object of the invention to provide a simple method for the active damping of combustion oscillation in a combustion chamber and a combustion apparatus in which the active damping of the combustion oscillation is possible in a simple manner, which overcome the hereinafore-mentioned disadvantages of the heretofore-known methods and devices of this general type.

With the foregoing and other objects in view there is provided, in accordance with the invention, a method for the active damping of combustion oscillation, which comprises supplying each of at least two burners of a combustion chamber with at least one medium for combustion; damping combustion oscillation by control of at least two actuating members each influencing a regulating variable being a quantity of the at least one medium supplied to one of the burners; determining measured variables characterizing the combustion oscillation at least at one measuring point; and controlling the actuating members through a number of the measured variables being smaller than the number of the actuating members.

This method makes it possible, at a low outlay in terms of measurement, to carry out regulation for the active damping of combustion oscillation. The term "regulating variable" means a system variable which is described by a physical variable, for example a fuel quantity supplied at a specific point. In this sense, another regulating variable would, for example, be a fuel quantity supplied at another point or, for example, a quantity of combustion air supplied. An actuating member is accordingly not necessarily to be interpreted as a unit of equipment. The term "actuating member" may also embrace two or more devices which jointly influence a regulating variable, for example two loudspeakers that jointly modulate a combustion-air mass flow.

In accordance with another mode of the invention, fuel and combustion air are supplied for combustion, and a quantity of fuel supplied for combustion and/or a quantity of combustion air supplied for combustion is preferably used as a regulating variable, although other regulating variables may also be used at the same time. The fuel mass flow and/or the combustion-air mass flow is preferably modulated. It is consequently possible to carry out the active damping of combustion oscillation through the modulation of the fuel quantity supplied and/or of the combustion-air quantity supplied.

In combustion oscillation, natural acoustic oscillation or a sound field forms in the combustion chamber. A sound field is characterized by characteristic sound-field variables, such as, for example, sound pressure and sound velocity, the time profiles of which have particular periodic regularities. A sound field typically has spatial regions, within which the soundfield variables oscillate periodically at different amplitudes. Sound-field variables in different spatial regions of the sound field are shifted relative to one another in time in their oscillations in a manner which is characteristic of the sound field. In other words, they have a characteristic phase shift. If the spatial regions described have some regularity in their features, this is referred to as symmetry of the sound field.

In accordance with a further mode of the invention, exactly as many measured variables as are necessary for characterizing the natural oscillation are determined.

In accordance with an added mode of the invention, the control of at least one actuating member is preferably determined through the symmetry of the natural acoustic oscillation. The natural acoustic oscillation is characterized with the aid of a number of measured variables. The regulation of the actuating members is derived from this knowledge of the existing sound field through the symmetry of the natural acoustic oscillation in the combustion chamber. This is accomplished by taking into account the respective spatial position in which an actuating member influences the combustion oscillation. The phase and amplitude of the combustion oscillation at the point of action of an actuating member are known from the characterization of the natural acoustic oscillation. The regulation of each actuating member, as is necessary for damping the combustion oscillation, is thus obtained. The number of measuring points is therefore determined solely by the number of measuring points necessary for characterizing the natural oscillation.

In accordance with an additional mode of the invention, the actuating members are controlled anti-cyclically to the combustion oscillation. Anti-cyclic control brings about particularly efficient damping of the combustion oscillation. Anti-cyclic control denotes a regulating variable fluctuation which is inverted in relation to the self-excited combustion oscillation. In the case of harmonic combustion oscillation, this means that the regulating variable is applied with the same frequency, but in phase opposition.

In accordance with yet another mode of the invention, the method is employed in an annular combustion chamber of a gas turbine. An annular combustion chamber of a gas turbine has a relatively large number of burners which may each excite combustion oscillation. It is desirable to have the possibility of carrying out active damping of combustion oscillation for each burner through the use of its own actuating member. The number of measured variables to be determined for these actuating members may be kept small.

With the objects of the invention in view there is also provided a combustion apparatus, comprising a combustion chamber having at least two burners each to be supplied with at least one medium for combustion in the combustion chamber; and at least one modulating device including at least one sensor for recording a measured variable characterizing a combustion oscillation, a controller connected to the at least one sensor for converting a signal from the sensor into a regulating signal, at least two actuating members connected to the controller, each of the actuating members for modulating one regulating variable being a quantity of a medium supplied to one of the burners, and the at least one sensor being smaller in number than the number of the actuating members.

In this case, two or more actuating members may be present due to the fact that a modulating device includes two or more actuating members or to the fact that two or modulating devices are present. Through the use of this combustion apparatus, it is possible to reduce the necessary number of controllers and sensors and thus carry out active damping of combustion oscillation at a low outlay in terms of construction. The saving of sensors and controllers which is achieved in this way leads to considerable cost savings.

In accordance with another feature of the invention, each burner has a fuel supply and a combustion-air supply, and at least one actuating member is connected to the fuel supply and/or to the combustion-air supply. It is consequently possible to carry out the damping of combustion oscillation by regulating the fuel quantity supplied or the combustion air quantity supplied. At the same time, one actuating member or a plurality of actuating members may also modulate another regulating variable or other regulating variables.

In accordance with a further feature of the invention, the burners are hybrid burners, each including a premixing burner and a pilot burner. The principle of a hybrid burner is described in an article entitled "Progress in NOx and CO Emission Reduction of Gas Turbines", by H. Maghon, P. Behrenbrink, H. Termuehlen and G. Gartner, in ASME/IEEE Power Generation Conference, Boston, October 1990, to which reference is hereby made explicitly.

In accordance with a concomitant feature of the invention, the combustion chamber is an annular combustion chamber of a gas turbine.

Other features which are considered as characteristic for the invention are set forth in the appended claims.

Although the invention is illustrated and described herein as embodied in a method for the active damping of combustion oscillation and a combustion apparatus, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

BRIEF DESCRIPTION OF THE DRAWINGS

The FIGURE of the drawing is a schematic and block circuit diagram of a method for the active damping of a combustion oscillation and a corresponding combustion apparatus.

DESCRIPTION OF THE PREFERRED EMBODIMENTS

Referring now in detail to the single FIGURE of the drawing, there is seen a gas turbine 33 directed along an axis 31. A compressor 2 is flow-connected to a turbine 3. A combustion apparatus 1 is connected between the compressor 2 and the turbine 3. The combustion apparatus 1 is formed of a combustion chamber 4 and hybrid burners 5 which open into the combustion chamber 4. Each hybrid burner 5 is composed of a conical premixing burner 6 which at the same time forms a combustion-air supply 6*a*. The premixing burner 6 surrounds a pilot burner 7 having its own combustion-air supply 7*a*. Fuel 28 is supplied to each premixing burner 6 through a fuel supply conduit 23. Fuel 28 is supplied to each pilot burner 7 through a fuel supply conduit 24. The hybrid burners 5 are disposed partly in the combustion chamber 4 and partly in a prechamber 4*a* adjacent the combustion chamber 4. An actuating member 8 is built into each fuel supply conduit 24 of the pilot burners 7. The actuating members 8 are connected electrically to a common logical control unit 9. The control unit 9 is connected electrically to a controller 10. The controller 10 is in turn connected electrically to a pressure sensor 11, in particular a piezoelectric pressure transducer. The pressure sensor 11 is disposed at a measuring point 11*a* in the combustion chamber 4.

When the gas turbine 1 is in operation, combustion air 29 is compressed in the compressor 2 and is conducted into the prechamber 4*a* through a duct 21. The combustion air 29 passes out of the prechamber 4*a* into the air supply ducts 6*a*, 7*a* of the premixing burners 6 and of the pilot burners 7. The fuel 28 is supplied to the pilot burners 7 through the fuel supply conduits 24 and is burned in the combustion air 29 as a pilot flame. The fuel 28 is supplied to the premixing burners 6 through the fuel supply conduits 23 and is mixed with the combustion air 29. The fuel/air mixture entering the combustion chamber 4 is ignited at the pilot flame. Combustion oscillation may occur as a result of interaction with the acoustics of the combustion chamber 4. Such combustion oscillation causes natural acoustic oscillation 30 or a sound field 30 in the combustion chamber 4.

This natural acoustic oscillation 30 is measured by the pressure sensor 11 and the pressure sensor 11 emits a measurement signal. This measurement signal is converted into a regulating signal in the controller 10. Control of the actuating members 8 is determined from this regulating signal with the aid of the logical control unit 9. In this case, the control is derived from the spatial position of a burner 5 and from the symmetry of the natural acoustic oscillation 30. The supply of fuel for the pilot burners 7 is regulated anti-cyclically to the combustion oscillation. In other words, the fuel mass flow of each pilot burner 7 is modulated in such a way that the fuel quantity injected into the combustion chamber 4 changes in time at the location of the flame or the combustion zone of the respective pilot burner 7 in phase opposition and with the same frequency as the combustion oscillation at the location of the flame. This results in damping of the combustion oscillation. The control of the actuating members 8 thus necessitates measurement at only one measuring point 11*a*. One sensor 11 and one controller 10 are saved.

A simple method for the active damping of combustion oscillation and a combustion apparatus of simple construction, in which active damping of combustion oscillation can be carried out, are obtained. The method is also suitable, in particular, for a combustion chamber 4 with more than two burners 5, for example for an annular combustion chamber, or a silo combustion chamber with eight burners, for example. The number of sensors 11 and controllers 10 is preferably just as large as is necessary for characterizing the natural acoustic oscillation 30. A quantity of the fuel 28 or a quantity of the combustion air 29 supplied for combustion may be used as a regulating variable.

We claim:

1. A method for the active damping of combustion oscillation, which comprises:

supplying each of at least two burners of a combustion chamber with at least one medium for combustion;

damping combustion oscillation by control of at least two actuating members each influencing a regulating variable being a quantity of the at least one medium supplied to one of the burners;

selecting a quantity of measuring points wherein the quantity of the measuring points is smaller than the quantity of the actuating members and includes at least one measuring point;

measuring a variable characterizing the combustion oscillation at the at least one measuring point; and controlling the actuating members using the measured variable at the at least one measuring point.

2. The method according to claim 1, which comprises using a quantity of fuel supplied for combustion as a regulating variable.

3. The method according to claim 1, which comprises using a quantity of combustion air supplied for combustion as a regulating variable.

4. The method according to claim 1, which comprises characterizing the combustion oscillation using the measured variable and controlling at least one of the actuating members by taking into account a symmetry of the combustion oscillation.

5. The method according to claim 1, which comprises controlling the actuating members anti-cyclically to the combustion oscillation.

* * * * *